US009122191B2

(12) United States Patent
Mori et al.

(10) Patent No.: US 9,122,191 B2
(45) **Date of Patent: *Sep. 1, 2015**

(54) IMAGE FORMING APPARATUS AND DEVELOPING UNIT FOR USE IN IMAGE FORMING APPARATUS

(71) Applicant: Brother Kogyo Kabushiki Kaisha, Nagoya-shi, Aichi-ken (JP)

(72) Inventors: Hirotaka Mori, Nagoya (JP); Makoto Souda, Nagoya (JP); Shougo Sato, Seto (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/543,304

(22) Filed: Nov. 17, 2014

(65) Prior Publication Data

US 2015/0071682 A1 Mar. 12, 2015

Related U.S. Application Data

(63) Continuation of application No. 13/626,135, filed on Sep. 25, 2012, now Pat. No. 8,892,001.

(30) Foreign Application Priority Data

Dec. 28, 2011 (JP) ..... 2011-288487

(51) Int. Cl.

| | |
|---|---|
| ***G03G 15/00*** | (2006.01) |
| ***G03G 15/043*** | (2006.01) |
| ***G03G 15/01*** | (2006.01) |
| ***G03G 21/16*** | (2006.01) |

(52) U.S. Cl.

CPC ..... *G03G 15/043* (2013.01); *G03G 15/0189* (2013.01); *G03G 21/1647* (2013.01); *G03G 21/1666* (2013.01); *G03G 21/1676* (2013.01)

(58) Field of Classification Search

USPC ..... 399/110, 111, 113, 118, 119

See application file for complete search history.

(56) References Cited

U.S. PATENT DOCUMENTS 7,777,769 B2 * 8/2010 Nozawa ..... 347/149

FOREIGN PATENT DOCUMENTS

| | | | |
|---|---|---|---|
| JP | 2-148149 | U | 12/1990 |
| JP | 05249767 | A | 9/1993 |
| JP | 07104567 | A | 4/1995 |
| JP | 2006018126 | A | 1/2006 |
| JP | 2006018127 | A | 1/2006 |
| JP | 2006018128 | A | 1/2006 |
| JP | 2010256920 | A | 11/2010 |

* cited by examiner

*Primary Examiner* — Hoang Ngo

(74) *Attorney, Agent, or Firm* — Banner & Witcoff, Ltd.

(57) ABSTRACT

A photosensitive drum extends in an axial direction. An irradiating unit includes a first reacting portion and a second reacting portion spaced from each other in the axial direction. A moving member includes a first acting portion and a second acting portion spaced from each other in the axial direction. The first acting portion and the second acting portion of the moving member act on the first reacting portion and the second reacting portion respectively, in response to attachment of the developing unit to a main body, such that the irradiating unit moves from the retracted position to the proximate position with respect to the photosensitive drum, and cancel the actions on the first reacting portion and the second reacting portion respectively, in response to removal of the developing unit from the main body, such that the irradiating unit moves from the proximate position to the retracted position.

10 Claims, 9 Drawing Sheets

IMAGE FORMING APPARATUS AND DEVELOPING UNIT FOR USE IN IMAGE FORMING APPARATUS

CROSS REFERENCE TO RELATED APPLICATION

This application is a continuation application of prior U.S. application Ser. No. 13/626,135, filed Sep. 25, 2012, which claims priority from Japanese Patent Application No. 2011-288487, filed on Dec. 28, 2011, the entire disclosure of which is incorporated herein by reference.

BACKGROUND OF THE INVENTION

1. Field of the Invention

The present invention relates to an electrophotographic image forming apparatus and a developing unit for use in an electrophotographic image forming apparatus.

2. Description of Related Art

A known electrophotographic image forming apparatus comprises a photosensitive drum, a replaceable developing unit configured to supply toner to the photosensitive drum, and an LED head configured to irradiate the photosensitive drum. When the developing unit is removed from an apparatus main body, the LED head is configured to move, by movements of several components, e.g., an arm, a wire, and a lever, between an irradiating position proximate to the photosensitive drum and a separated position largely separated from the photosensitive drum.

SUMMARY OF THE INVENTION

It may be beneficial for an image forming apparatus to include a developing unit configured to be removably attached to a main body of the apparatus and an irradiating unit configured to move with respect to a photosensitive drum in a stable manner, in response to attachment and removal of the developing unit to and from the main body of the apparatus.

According to an embodiment of the invention, an image forming apparatus comprises a main body, a drum unit comprising a photosensitive drum configured to rotate about an axis extending in an axial direction and carry a developer image, a developing unit which comprises a developing roller configured to supply a developer to the photosensitive drum and is configured to be attached to and removed from the main body in the axial direction, an irradiating unit which comprises a light emitting member configured to irradiate the photosensitive drum and is configured to move between a retracted position and a proximate position which is closer to the photosensitive drum than the retracted position, and a moving member extending in the axial direction and configured to move in the axial direction in response to attachment and removal of the developing unit to and from the main body. The moving member comprises a first acting portion and a second acting portion which are spaced from each other in the axial direction. The irradiating unit comprises a first reacting portion and a second reacting portion which are spaced from each other in the axial direction. The first acting portion and the second acting portion are configured to act on the first reacting portion and the second reacting portion respectively, in response to attachment of the developing unit to the main body, such that the irradiating unit moves from the retracted position to the proximate position. The first acting portion and the second acting portion are configured to cancel the actions on the first reacting portion and the second reacting portion respectively, in response to removal of the developing unit from the main body, such that the irradiating unit moves from the proximate position to the retracted position.

According to another embodiment of the invention an image forming apparatus comprises a main body, a drum unit comprising a photosensitive drum configured to rotate about an axis extending in an axial direction and carry a developer image, a developing unit which comprises a developing roller configured to supply a developer to the photosensitive drum and is configured to be attached to and removed from the main body in the axial direction, an irradiating unit comprising a light emitting member and a cam follower. The light emitting member is configured to irradiate the photosensitive drum, and the irradiating unit is configured to move between a retracted position and a proximate position which is closer to the photosensitive drum than the retracted position. The image forming apparatus further comprises a cam configured such that the cam flower follows the cam, in response to attachment of the developing unit to the main body, so as to move the irradiating unit from the retracted position to the proximate position, and such that the cam follower follows the cam, in response to removal of the developing unit from the main body, so as to move the irradiating unit from the proximate position to the retracted position.

According to another embodiment of the invention, a developing unit for use in an image forming apparatus comprises a developing roller configured to rotate about an axis extending in an axial direction and supply a developer to a photosensitive drum, and a moving member extending in the axial direction and comprising a first acting portion and a second acting portion which are spaced from each other in the axial direction. In response to attachment of the developing unit to the image forming apparatus along a predetermined direction while the axial direction of the developing roller is maintained parallel to the predetermined direction, the first acting portion and a second acting portion of the moving member are configured to act on a first reacting portion and a second reacting portion of an irradiating unit respectively, such that the irradiating unit moves from a retracted position to a proximate position which is closer to the photosensitive drum than the retracted position. In response to removal of the developing unit from the image forming apparatus along the predetermined direction, the first acting portion and the second acting portion of the moving member are configured to cancel the actions on the first reacting portion and the second reacting portion of the irradiating unit respectively, such that the irradiating unit moves from the proximate position to the retracted position.

According to another embodiment of the invention, a developing unit for use in an image forming apparatus comprises a developing roller configured to rotate about an axis extending in an axial direction and supply a developer to a photosensitive drum, and a pressing portion. In response to attachment of the developing unit to the image forming apparatus along a predetermined direction while the axial direction of the developing roller is maintained parallel to the predetermined direction, the pressing portion is configured to press a moving member against an urging force in a first direction along the predetermined direction such that a first acting portion and a second acting portion of the moving member act on a first reacting portion and a second reacting portion of an irradiating unit respectively so as to move the irradiating unit from a retracted position to a proximate position which is closer to the photosensitive drum than the retracted position. In response to removal of the developing unit to the image forming apparatus along the predetermined direction, the pressing portion is configured to release the moving member to move in a second direction opposite to the first direction such that the first acting portion and the second acting portion of the moving member cancel the actions on the first reacting portion and the second reacting portion of the irradiating unit respectively so as to move the irradiating unit from the proximate position to the retracted position.

According to another embodiment of the invention, a developing unit for use in an image forming apparatus comprises a developing roller configured to rotate about an axis extending in an axial direction and supply a developer to a photosensitive drum, and a cam. The cam is configured such that, in response to attachment of the developing unit to the image forming apparatus along a predetermined direction while the axial direction of the developing roller is maintained parallel to the predetermined direction, a cam follower of an irradiating unit follows the cam so as to move the irradiating unit from a retracted position to a proximate position which is closer to the photosensitive drum than the retracted position, The cam is configured such that, in response to removal of the developing unit from the image forming apparatus along the predetermined direction, the cam follower follows the cam so as to move the irradiating unit from the proximate position to the retracted position.

Other objects, features, and advantages will be apparent to persons of ordinary skill in the art from the following detailed description of the invention and the accompanying drawings.

BRIEF DESCRIPTION OF THE DRAWINGS

For a more complete understanding of the invention, the needs satisfied thereby, and the features and technical advantages thereof, reference now is made to the following descriptions taken in connection with the accompanying drawings.

DETAILED DESCRIPTION OF EMBODIMENTS

Embodiments of the invention and their features and technical advantages may be understood by referring to FIGS. 1-9B, like numerals being used for like corresponding parts in the various drawings.

Figure 1:
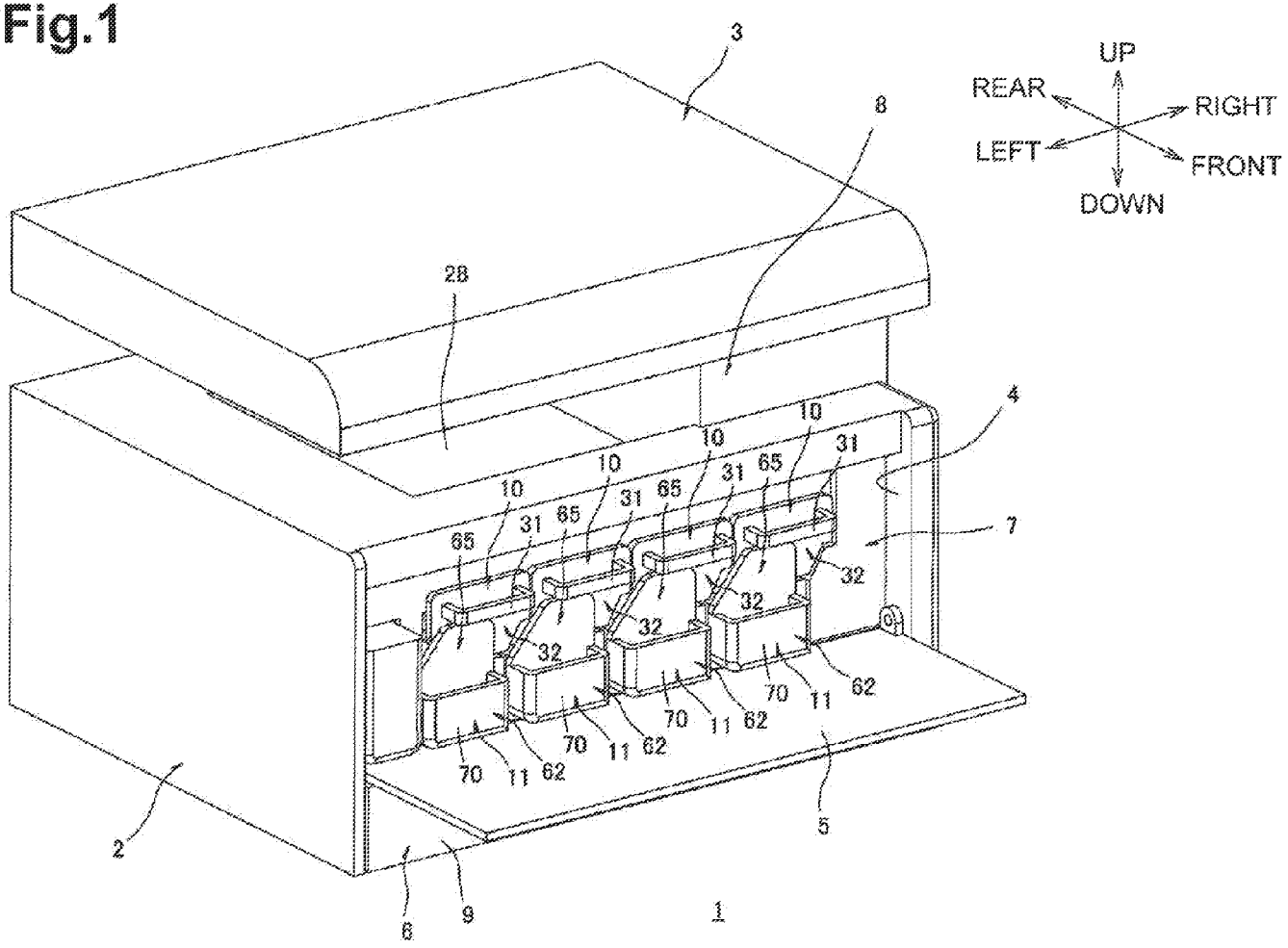
FIG. 1 is a perspective view of an image forming apparatus, e.g., a printer, according to a first embodiment of the invention, as viewed from an upper front side.
Figure 2:
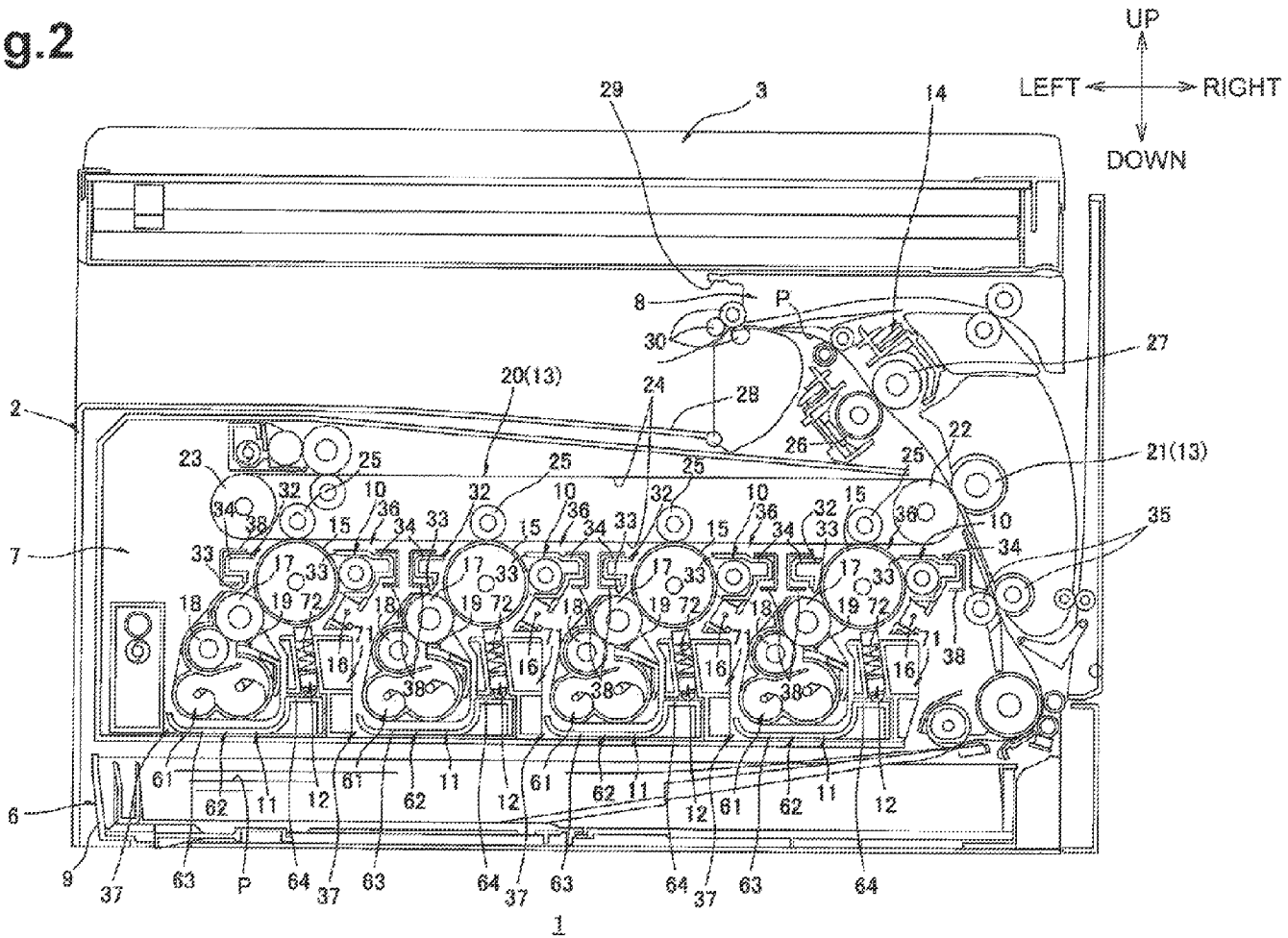
FIG. 2 is a central cross-sectional view of the printer of FIG. 1.

According to a first embodiment of the invention, as illustrated in FIGS. 1 and 2, an image forming apparatus, e.g., a printer 1, is an intermediate transfer color printer. The printer 1 is a multi-function device which integrally includes a main body, e.g., a casing 2, and a flatbed scanner 3. The flatbed scanner 3 reads image information of a document.

As illustrated in FIG. 1, the casing 2 has a substantially box shape. An opening 4 is formed in one of side walls of the casing 2. The casing 2 includes a front cover 5 which is configured to swing about a lower end portion thereof to open and close the opening 4.

In the following description, the side on which the front cover 5 is disposed, i.e., the near side of FIG. 1, is a front side, and the opposite side, i.e., the far side of FIG. 1, is a rear side. The left and right sides of the printer 1 are defined on the basis of the sides when the printer 1 is seen from the front. In particular, the right side of FIG. 1 is the right side and the left side of FIG. 1 is the left side of the printer 1.

The casing 2 includes a sheet feed unit 6, an image forming unit 7, and a discharge unit 8. The sheet feed unit 6 feeds a sheet P. The image forming unit 7 forms an image on the fed sheet P. The discharge unit 8 discharges the sheet P on which an image is formed.

The sheet feed unit 6 is disposed at the bottom of the casing 2. A feed tray 9 for containing sheets P is removably attached to the sheet feed unit 6. The sheets P in the feed tray 9 is conveyed one at a time by various rollers and registered by registration rollers 35. The sheet P is then fed, at a predetermined timing, to a position between an intermediate transfer belt 24 and a secondary transfer roller 21 which are described later.

The image forming unit 7 is disposed on the upper side of the sheet feed unit 6. The image forming unit 7 includes four drum units 10, four developing units 11, four irradiating units, e.g., four LED units 12, a transfer unit 13, and a fusing unit 14.

Figure 6:
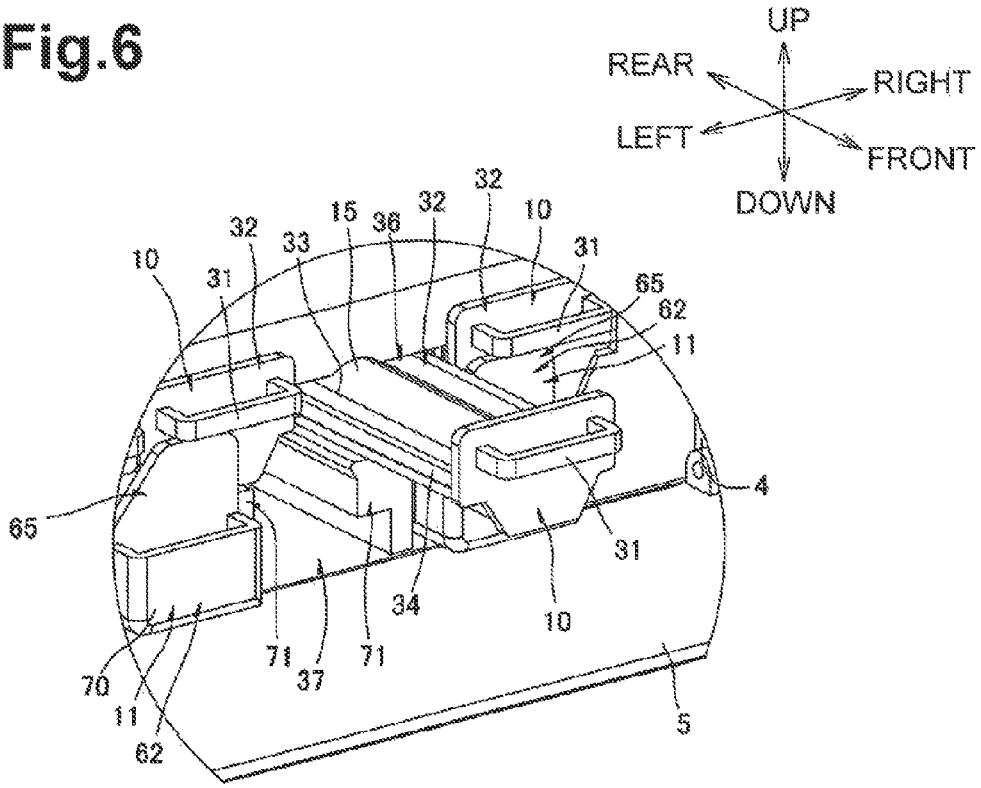
FIG. 6 is a perspective view of a drum unit of the printer as viewed from the upper front side, showing attachment and removal of the drum unit with respect to the casing.

The four drum units 10 for four colors of black, yellow, magenta, and cyan, respectively, are disposed in parallel with one another with a certain space in the left-right direction. As illustrated in FIG. 6, each drum unit 10 has a substantially rectangular cylinder shape elongated in the front-rear direction, and is disposed in the casing 2 removably in the front-rear direction. Each drum unit 10 includes, on a front wall thereof, a handle 31 which protrudes frontward.

Each drum unit 10 includes a drum frame 32, a photosensitive drum 15, and a scorotron charging unit 16. The drum frame 32 has a substantially rectangular prism shape closed at front and rear end portions. An upper end portion and a lower left end portion of the drum frame 32 each includes an opening 33 through which the photosensitive drum 15 is exposed. An elongated protrusion 34, which protrudes outward in the left-right direction and extends in the front-rear direction, is formed at left and right ends of the upper end portion of the drum frame 32. The photosensitive drum 15 has a substantially cylindrical shape elongated in an axial direction, e.g., in the front-rear direction, and is rotatably held in the drum frame 32. The scorotron charging unit 16 is held by the drum frame 32 so as to oppose the photosensitive drum 15 with a space on the right side of the photosensitive drum 15.

Each of the four developing units 11 is disposed on the lower left side of a corresponding one of the drum units 10 so as to oppose the corresponding drum unit 10. Each developing unit 11 is removable in the front-rear direction with respect to the casing 2. Each developing unit 11 includes a developing roller 17. The developing roller 17 is rotatably held at an upper end of the developing unit 11 and is exposed at its upper side. The developing roller 17 is in contact with the photosensitive drum 15 of the corresponding drum unit 10 from below. The developing unit 11 includes a supply roller 18 and a blade 19. The supply roller 18 supplies toner to the developing roller 17. The blade 19 regulates thickness of the toner supplied to the developing roller 17. Toner, as an example of a developer, is contained under the supply roller 18 in the developing unit 11.

Each of the four LED units 12 is disposed on the lower side of a corresponding one of the photosensitive drum 15 so as to oppose the corresponding photosensitive drum 15. Each LED unit 12 irradiates a surface of the corresponding photosensitive drum 15 based on predetermined image data.

The transfer unit 13 includes a belt unit 20 and a secondary transfer roller 21. The belt unit 20 is disposed along the left-right direction so as to face all the photosensitive drums 15 from above. The belt unit 20 includes a driving roller 22, a driven roller 23, an endless belt, e.g., an intermediate transfer belt 24, and four primary transfer rollers 25.

The driving roller 22 and the driven roller 23 are opposite to each other with a space therebetween in the left-right direction. The intermediate transfer belt 24 is stretched around the driving roller 22 and the driven roller 23 to be in contact with all the photosensitive drums 15 at a lower portion thereof. The driving roller 22 drives to circulate the intermediate transfer belt 24 such that the lower portion of the intermediate transfer belt 24 moves from the left to the right.

Each of the primary transfer rollers 25 opposes the photosensitive drum 15 of a corresponding one of the drum units 10 via the lower portion of the intermediate transfer belt 24 therebetween. The secondary transfer roller 21 is disposed on the right side of the belt unit 20 so as to oppose the driving roller 22 of the belt unit 20 via the intermediate transfer belt 24 therebetween.

A fusing unit 14 is disposed on the upper side of the secondary transfer roller 21. The fusing unit 14 includes a heat roller 26 and a pressure roller 27 which opposes the heat roller 26.

Toner in the developing unit 11 is supplied to the supply roller 18 and then supplied to the developing roller 17. The toner supplied to the developing roller 17 is positively charged by friction between the supply roller 18 and the developing roller 17 when the developing roller 17 rotates. Thickness of the toner is regulated by the blade 19. The toner is carried on a surface of the developing roller 17 as a thin layer of constant thickness.

A surface of the photoconductor drum 15 is positively charged uniformly by the scorotron charging unit 16 as the photoconductor drum 15 rotates, and is then irradiated by the LED unit 12. In this manner, an electrostatic latent image corresponding to an image to be formed on the paper sheet P is formed on the surface of the photoconductor drum 15. As the photoconductor drum 15 further rotates, the toner carried on the surface of the developing roller 17 is supplied to the electrostatic latent image on the surface of the photoconductor drum 15. Then, a toner image, e.g., a developer image, is formed by reversal development and is carried on the surface of the photosensitive drum 15.

The toner image carried on the surface of the photosensitive drum 15 is transferred primarily to a lower portion of the intermediate transfer belt 24 when the intermediate transfer belt 24 moves from the left to the right. The toner image transferred to the intermediate transfer belt 24 is transferred secondarily to the sheet P supplied from the sheet feed unit 6 while the intermediate transfer belt 24 passes through a position in which the intermediate transfer belt 24 opposes the secondary transfer roller 21.

In the fusing unit 14, the toner image transferred to the paper sheet P is heat-fused to the sheet P with heat and pressure while the sheet P passes through between the heat roller 26 and the pressure rollers 27.

A discharge tray 28 onto which paper sheet P is discharged is formed on an upper surface of the casing 2. In an upper right end portion of the casing 2, the discharge unit 8 protrudes further upward than the discharge tray 28. The discharge unit 8 includes, at a position higher than the discharge tray 28, a discharge port 29 through which the sheet P is discharged. The discharge unit 8 includes three discharge rollers 30 disposed inside the discharge port 29 to convey the sheet P to the discharge tray 28. The sheet P on which the toner image is fused in the fusing unit 14 is discharged onto the discharge tray 28 by the discharge rollers 30.

The flatbed scanner 3 is held by an upper end portion of the discharge unit 8 while leaving a space above the discharge tray 28.

Figure 3:
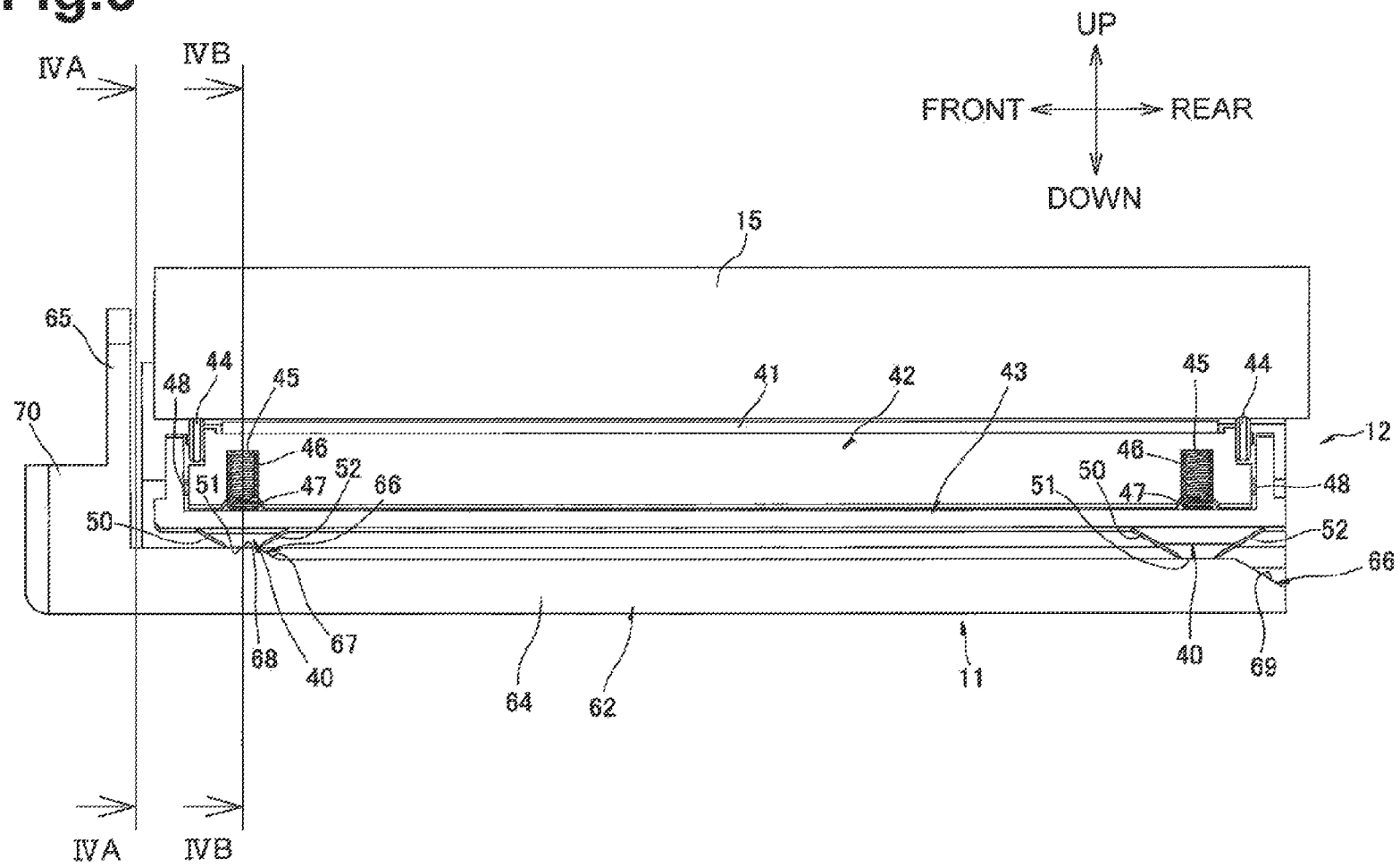
FIG. 3 is a right side view of an LED unit of the printer of FIG. 1.
Figure 4A:
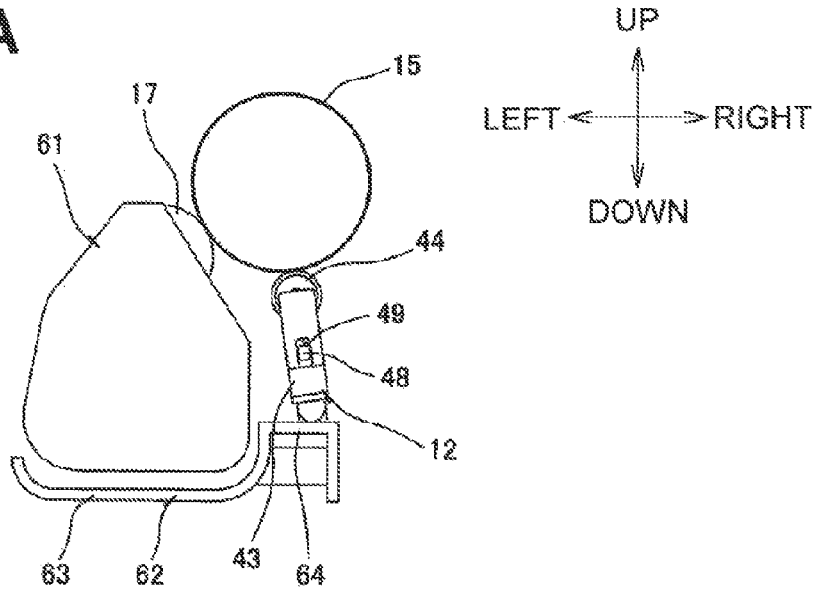
FIG. 4A is a schematic cross-sectional view of FIG. 3 cut away along line IVA-IVA.
Figure 4B:
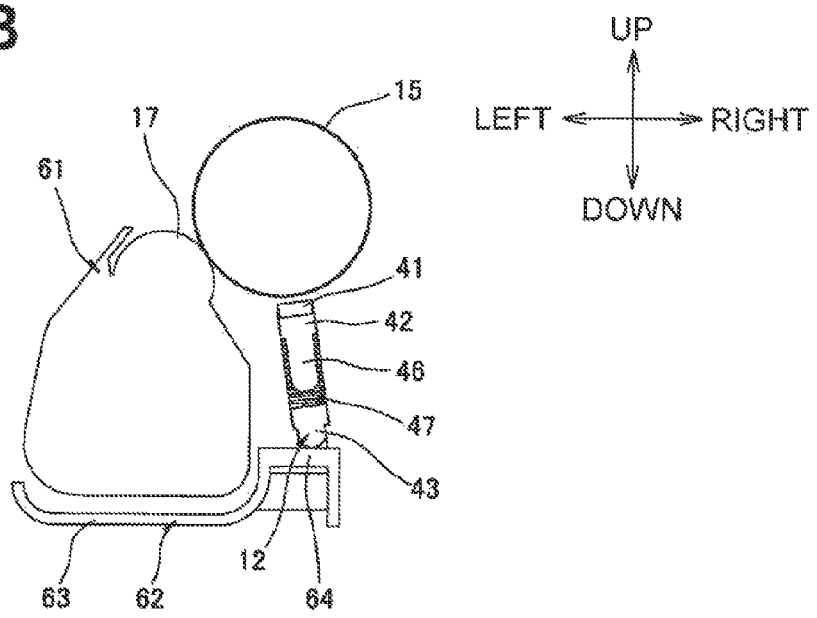
FIG. 4B is a schematic cross-sectional view of FIG. 3 cut away along line IVB-IVB.

As illustrated in FIGS. 3, 4A and 4B, each LED unit 12 includes, a light emitting member, e.g., an LED array 41, a first frame 42 which holds the LED array 41, and a second frame 43 which holds the first frame 42.

The LED array 41 is disposed at an upper end portion of the LED unit 12. The LED array 41 has a substantially plate shape extending in the front-rear direction. The LED array 41 holds, in an integrated manner, multiple LEDs which are arranged in parallel in the front-rear direction. The length of the LED array 41 in the front-rear direction is shorter than the length of the photosensitive drum 15 in the front-rear direction, and is longer than the length of a sheet passing area of the photosensitive drum 15 in the front-rear direction.

The first frame 42 is disposed on the lower side of the LED array 41. The first frame 42 has a substantially plate shape extending in the front, rear, upper and lower directions and is elongated in the front-rear direction. The length of the first frame 42 in the front-rear direction is shorter than the length of the photosensitive drum 15 in the front-rear direction, and is longer than the length of the LED array 41 in the front-rear direction. The first frame 42 holds the LED array 41 in an upper end portion thereof.

The first frame 42 includes two positioning rollers 44, two spring holders 45, and two guide bosses 48. The positioning rollers 44 are each an example of a distance adjusting member. The spring holders 45 each hold a compression spring 47 which is described later. The guide bosses 48 are inserted in guide holes 49, which are described later, of the second frame 43.

Each of the two positioning rollers 44 has a substantially disc shape. One of the positioning rollers 44 is rotatably held at a front end portion and the other is rotatably held at a rear end portion of the upper end portion of the first frame 42. Each of the positioning rollers 44 slightly protrudes further upward than the LED array 41. The positioning rollers 44 are in contact with the photosensitive drum 15 from below. In this configuration, the positioning rollers 44 position the LED array 41 so as to oppose the photosensitive drum 15 with a distance which corresponds to the protruding length of the positioning rollers 44.

One of the two spring holders 45 is disposed in a front portion and the other is disposed at a rear end portion of the first frame 42. Each spring holder 45 is formed as a groove recessed upward from a lower end edge of the first frame 42. Each spring holder 45 includes a holding boss 46 and the compression spring 47.

The holding boss 46 has a substantially cylindrical shape and extends downward from the center in the front-rear direction of an upper inner surface of the spring holder 45 so as to be spaced from an inner surface of the spring holder 45 in the front-rear direction. The compression spring 47 is held in the spring holder 45 so as to fit on the holding boss 46 from the outside in the radial direction of the holding boss 46 with play. The upper end portion of the compression spring 47 is in contact with the upper inner surface of the spring holder 45. The length of the compression spring 47 in the up-down direction is longer than the length of the spring holder 45 in the up-down direction. A lower end portion of the compression spring 47 protrudes downward from the spring holder 45.

One of the two guide bosses 48 is disposed at a front end portion and the other is disposed at a rear end portion of the first frame 42. Each guide boss 48 has a substantially rectangular prism shape extending outward in the front-rear direction from a front/rear outer surface of the first frame 42.

The second frame 43 is disposed on the lower side of the first frame 42 and opposes the first frame 42. The second frame 43 has, in a side view, a substantially rectangular frame shape open at its upper side so as to surround the first frame 42 from the front, back and below. The second frame 43 includes two reacting portions 40 and two guide holes 49 as illustrated in FIG. 4A.

One of the two reacting portions 40 is disposed at a front end portion of the second frame 43 and the other is disposed at a rear end portion of the second frame 43. The two reacting portions 40 each are an example of a cam follower. The reacting portion 40 has, in a side view, a substantially trapezoidal shape and protrudes downward from a lower end edge of the second frame 43. Specifically, the reacting portion 40 includes a front surface 50, a lower surface 51 and a rear surface 52. The front surface 50 is an example of an inclined surface which inclines downward from the front side to the rear side. The lower surface 51 continues from a rear end of the front surface 50 and extends rearward. The rear surface 52 continues from a rear end of the lower surface 51 and inclines upward from the front to the rear. The length in the front-rear direction and the length in the up-down direction of the reacting portion 40 disposed at the rear side is greater than those of the reacting portion 40 disposed at the rear side.

Each of the two guide holes 49 is formed, in a front view, in a substantially rectangular shape elongated in the up-down direction and penetrates substantially a center, in the up-down direction, of front/rear side wall of the second frame 43. The length of the guide hole 49 in the up-down direction is longer than the length of the guide boss 48 in the up-down direction. The length of the guide hole 49 in the left-right direction is slightly longer than the length of the guide boss 48 in the left-right direction.

The first frame 42 is held by the second frame 43 such that the guide boss 48 is inserted in the guide hole 49 from the inside in the left-right direction. On the upper side of the reacting portion 40, the lower end portion of the compression spring 47 is in contact with an upper wall of the second frame 43 from above. This allows the first frame 42 to elastically slide in the up-down direction relative to the second frame 43. The second frame 43 is held in the casing 2 to be movable in the up-down direction.

Figure 5A:
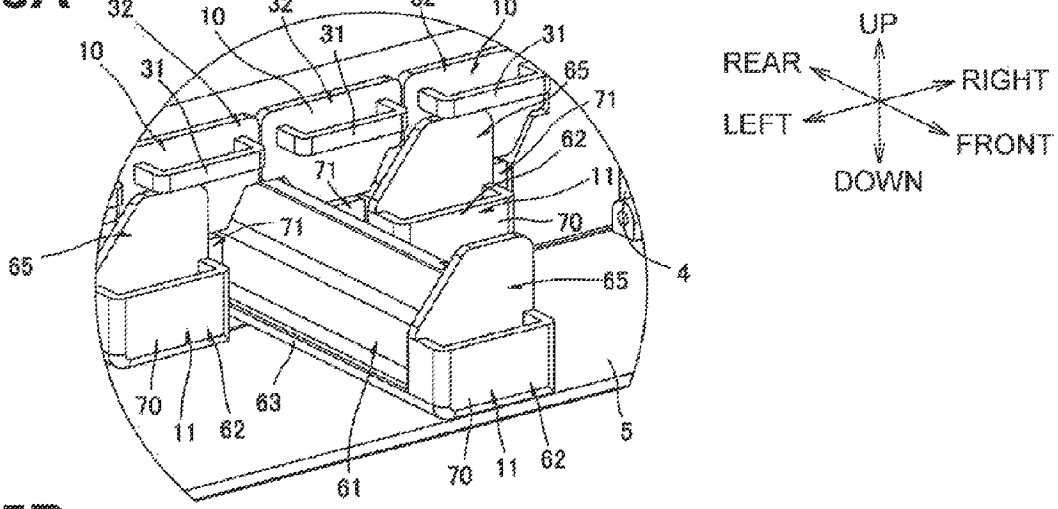
FIG. 5A is a perspective view of a developing unit of the printer as viewed from the upper front side, showing attachment and removal of the developing unit with respect to a casing.
Figure 5B:
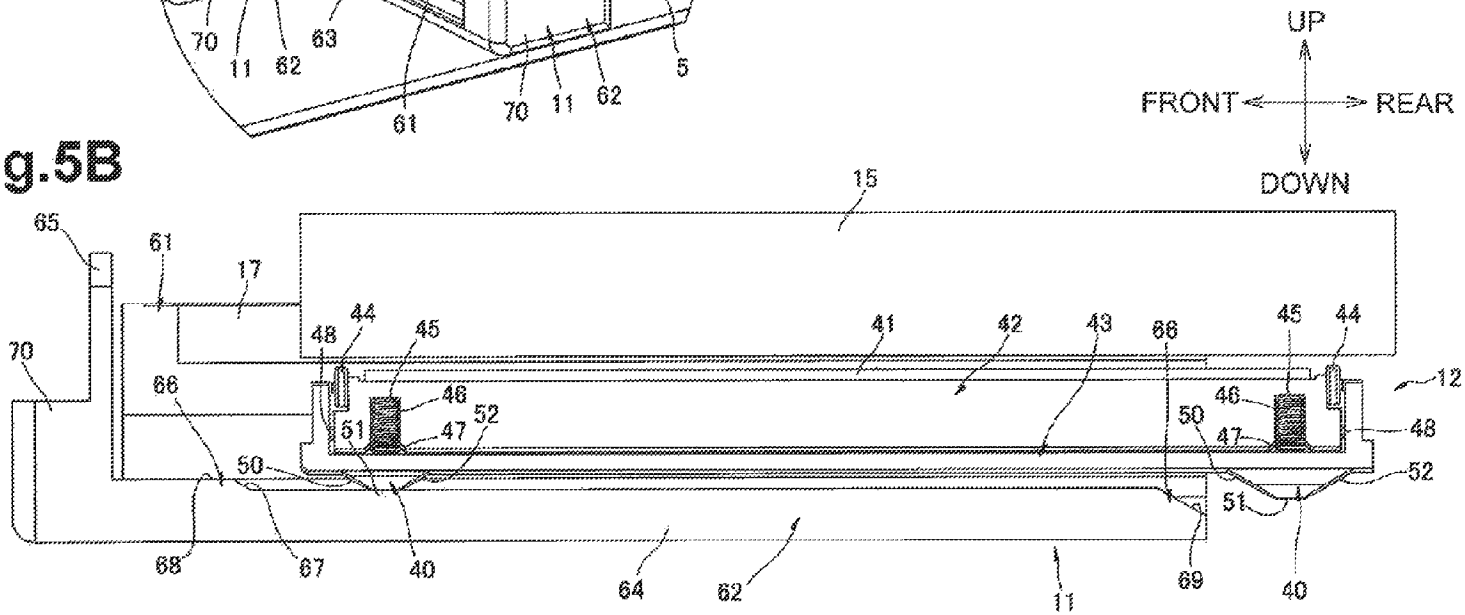
FIG. 5B is a right side view of the LED unit of the printer, showing attachment and removal of the developing unit with respect to the casing.

This allows the LED unit 12 to move in the up-down direction between a proximate position in which the positioning roller 44 is in contact with the photosensitive drum 15 as illustrated in FIG. 3, and a retracted position in which the positioning roller 44 is separated from the photosensitive drum 15 as illustrated in FIG. 5B.

As illustrated in FIGS. 1 and 2, the developing unit 11 includes a unit main body 61 and a holding frame 62 which holds the unit main body 61. The unit main body 61 has a substantially cylindrical shape and extends in the front-rear direction as illustrated in FIG. 5A. The unit main body 61 includes the developing roller 17, the supply roller 18 and the blade 19. The unit main body 61 contains toner. The unit main body 61 is held by holding frame 62 on a tray portion 63 to be described later.

The holding frame 62 integrally includes the tray portion 63, a cam portion 64, and a front wall 65. The tray portion 63 holds the unit main body 61. The cam portion 64 is an example of a moving member which moves the LED unit 12. The front wall 65 is an example of a preventing member which faces the front wall of the drum unit 10.

The tray portion 63 extends in the front-rear direction at a lower end portion of the holding frame 62 and has, in a cross sectional view, substantially a U shape opened at its upper side. The length of the tray portion 63 in the left-right direction is longer than the length of the unit main body 61 in the left-right direction. As illustrated in FIGS. 3, 4A and 4B, the cam portion 64 has a substantially rectangular prism shape continuing from the right side of the tray portion 63 and extending in the front-rear direction. Specifically, the cam portion 64 includes two acting portions 66. The two acting portions 66 each are an example of a cam. One of the two acting portions 66 is disposed at a front end portion of the cam portion 64 and the other is disposed at a rear end portion of the cam portion 64.

The acting portion 66 at the front side has, in a side view, a substantially rectangular shape protruding upward from an upper surface of the cam portion 64 and extending in the front-rear direction. Specifically, the acting portion 66 at the front side includes a rear surface 67 and an upper surface 68. The rear surface 67 is an example of an inclined surface and continues from the upper surface of the cam portion 64 and inclines upward toward the front. The upper surface 68 continues from a front end of the rear surface 67 and extends to the front.

The acting portion 66 at the rear side is a rear end portion of the cam portion 64. An upper surface 69 of the acting portion 66 at the rear side continues from the upper surface of the cam portion 64 and is cut to incline upward toward the front side. The upper surface 69 of the acting portion 66 at the rear side functions as an inclined surface.

The front wall 65 is disposed at a front end portion of the holding frame 62 and has, in a front view, a substantially rectangular flat plate shape extending upward from the tray portion 63 and the cam portion 64. The upper right end portion of the front wall 65 faces a lower left end portion of the front wall of the drum unit 10 from the front side. The front wall 65 includes, at the lower half portion thereof, a handle 70 which protrude to the front.

When the developing unit 11 is attached fully into the casing 2, the reacting portion 40 at the front side of the LED unit 12 is in contact with the upper surface 68 of the acting portion 66 at the front side, and a reacting portion 40 of the LED unit 12 at the rear side is in contact with the upper surface of the cam portion 64.

As illustrated in FIG. 2, the casing 2 includes, inside thereof, a drum unit receiver 36, a developing unit receiver 37 and an LED holding frame 71. The drum unit receiver 36 receives the drum unit 10. The developing unit receiver 37 receives the developing unit 11. The LED holding frame 71 holds the LED unit 12.

The drum unit receiver 36 has, in a front view, a substantially rectangular shape and is configured to receive the drum unit 10 disposed on the lower side of the belt unit 20. Holding rails 38 are disposed at both ends of the drum unit receiver 36 in the left-right direction. Each of the holding rails 38 has a groove substantially U-shaped in a front view and extending in the front-rear direction, and open to the inside in the left-right direction. The groove width of the holding rail 38 is greater than the length of an elongated protrusion 34 of the drum unit 10 in the up-down direction so as to receive the elongated protrusion 34.

The developing unit receiver 37 has, in a front view, a substantially rectangular shape which continues from a lower left side of the drum unit receiver 36 and is configured to receive the developing unit 11.

The LED holding frame 71 is fixed to the casing 2 and disposed on the lower side of the drum unit receiver 36. The LED holding frame 71 has a substantially rectangular prism shape extending in the front-rear direction. The LED holding frame 71 has, at a left end portion thereof, a holding groove 72 which slidably holds the LED unit 12. The holding groove 72 has, in a front view, a substantially linear shape extending in the up-down direction and open at upper and lower ends. The LED array 41 protrudes upward from an upper end portion of the holding groove 72 and the second frame 43 protrudes downward from a lower end portion of the holding groove 72. The cam portion 64 of the developing unit 11 is disposed on the lower side of the holding groove and opposes the holding groove 72.

First, with reference to FIGS. 5A, 5B and 6, removal of the developing unit 11 and the drum unit 10 from the casing 2 is described. In order to remove the developing unit 11 and the drum unit 10, the developing unit 11 is removed first from the casing 2. For the removal of the developing unit 11 from the casing 2, a user grasps the handle 70 of the holding frame 62 and pulls the developing unit 11 to the front as illustrated in FIG. 5A. At this time, the cam portion 64 is slid to the front and the upper surface 68 of the acting portion 66 at the front side disengages from the reacting portion 40 at the front side of the LED unit 12, and the upper surface 99 of the cam portion 64 disengages form the reacting portion 40 at the rear side of the LED unit 12. The front surface 50 of the reacting portion 40 at the front side of the LED unit 12 faces the rear surface 67 of the acting portion 66 at the front side. At the same time, the front surface 50 of the reacting portion 40 at the rear side of the LED unit 12 faces the upper surface 69 of the acting portion 66 at the rear side.

Then, the reacting portion 40 at the front side of the LED unit 12 moves downward along the inclination of the rear surface 67 of the acting portion 66 of the cam portion 64 at the front side. At the same time, the reacting portion 40 at the rear side of the LED unit 12 moves downward along the inclination of the upper surface 69 of the acting portion 66 at the rear side.

This allows the LED unit 12 to move downward from the proximate position in a direction away from the photosensitive drum 15 to the retracted position. When the developing unit 11 is further pulled to the front, the developing unit 11 is removed from the casing 2. When the developing unit 11 is removed from the casing 2, the facing relationship of the front wall 65 and the drum unit 10 is released to allow the drum unit 10 to be slid to the front.

For the removal of the drum unit 10 from the casing 2, the user grasps the handle 31 of the drum unit 10 and pulls the drum unit 10 to the front as illustrated in FIG. 6. Then, the drum unit 10 is removed from the casing 2. In this manner, the developing unit 11 and the drum unit 10 are removed from the casing 2.

Attachment of the developing unit 11 and the drum unit 10 to the casing 2 is described below. For the attachment of the developing unit 11 and the drum unit 10 to the casing 2, the developing unit 11 and the drum unit 10 are manipulated in the reverse order of that described above.

First, the drum unit 10 is mounted to the casing 2. For the attachment of the drum unit 10 to the casing 2, the user grasps the handle 31 of the drum unit 10 and inserts the rear end portion of the drum unit 10 in the drum unit receiver 36 such that each elongated protrusion 34 is fit into the corresponding holding rail 38 of the drum unit receiver 36 as illustrated in FIG. 6. The user then pushes the drum unit 10 to the rear side, the drum unit 10 is received in the drum unit receiver 36 such that each elongated protrusion 34 is guided by the corresponding holding rail 38. In this manner, the drum unit 10 is attached to the casing 2.

Next, the developing unit 11 is attached to the casing 2. For the attachment of the developing unit 11 to the casing 2, the user grasps the handle 70 of the holding frame 62, inserts the rear end portion of the developing unit 11 in the developing unit receiver 37, and pushes the developing unit 11 toward the rear side, i.e., toward the downstream side in the attaching direction from the front side, i.e., from the upstream side in the attaching direction as illustrated in FIG. 5A.

At this time, the rear end portion of the cam portion 64 is inserted in the developing unit receiver 37 so as to pass through the lower side of the reacting portion 40 at the front side of the LED unit 12, and the upper surface 69 of the acting portion 66 at the rear side faces the front surface 50 of the reacting portion 40 at the rear side of the LED unit 12. At the same time, the rear surface 67 of the acting portion 66 at the front side faces the front surface 50 of the reacting portion 40 at the front side of the LED unit 12.

When the user further pushes the developing unit 11 into the developing unit receiver 37, the rear surface 67 of the acting portion 66 of the cam portion 64 at the front side makes a sliding contact with the front surface 50 of the reacting portion 40 at the front side of the LED unit 12 and, at the same time, the upper surface 69 of the acting portion 66 at the rear side makes a sliding contact with the front surface 50 of the reacting portion 40 at the rear side of the LED unit 12. The LED unit 12 is pushed up to move up in a direction closer to the photosensitive drum 15 from the retracted position toward the proximate position.

When the user further pushes the developing unit 11 into the developing unit receiver 37, the positioning rollers 44 of the LED unit 12 make contact with a peripheral surface of the photosensitive drum 15 and the LED unit 12 is positioned with respect to the photosensitive drum 15. At the same time, the front wall 65 of the developing unit 11 faces the drum unit 10, whereby attachment of the developing unit 11 to the casing 2 is completed. In this manner, the developing unit 11 and the drum unit 10 are attached to the casing 2.

According to the printer 1 and the developing unit 11, as illustrated in FIGS. 3, 5A and 5B, a configuration in which the cam portion 64 disposed at a position lower than the LED array 41 of the LED unit 12 is moved in the front-rear direction allows the LED unit 12 to move between the proximate position in which the LED unit 12 is proximate to the photosensitive drum 15 and the retracted position in which the LED unit 12 is retracted from the photosensitive drum 15. The proximate position is closer to the photosensitive drum 15 than the retracted position. That is, this configuration allows the force in the front-rear direction produced by the movement of the cam portion 64 to be converted into the force in the direction in which the LED unit 12 moves closer to or away from the photosensitive drum 15, i.e., in the up-down direction.

Therefore, the LED unit 12 is allowed to move from the proximate position to the retracted position in a stable manner, in response to the removal of the developing unit 11 from the casing 2 and is allowed to move from the retracted position to the proximate position in a stable manner, in response to the attachment of the developing unit 11 to the casing 2. Therefore, the size of the printer 1 may be reduced in the direction in which the four drum units 10, each including the photosensitive drum 15, are arranged in parallel, i.e., in the left-right direction.

In the printer 1 and the developing unit 11 according to the first embodiment, as illustrated in FIG. 2, the drum unit 10, the LED unit 12 and the cam portion 64 may be disposed in the space under the intermediate transfer belt 24 in this order from the upper side to the lower side.

Therefore, the drum unit 10, the LED unit 12, and the cam portion 64 of the developing unit 11 may be disposed in a space-saving manner in the space defined by the path along which the sheet P is conveyed from the lower side to the upper side toward the intermediate transfer belt 24. The registration roller 35 for registering the sheet P may also be disposed using this space. Therefore, the size of the printer 1 in the up-down direction may be reduced.

In the printer 1 and the developing unit 11 according to the first embodiment, as illustrated in FIGS. 5A and 5B, the front wall 65 of the developing unit 11 may prevent the removal of the drum unit 10 from the casing 2 while the developing unit 11 is attached to the casing 2. The LED unit 12 may move from the proximate position to the retracted position when the developing unit 11 is removed from the casing 2 and, at the same time, the removal of the drum unit 10 from the casing 2 may be allowed.

Therefore, after the LED unit 12 is retracted from the photosensitive drum 15, the drum unit 10 may be removed from the casing 2. Interference between the photosensitive drum 15 and the LED unit 12 may be prevented at the time of attachment and removal of the drum unit 10.

The developing unit 11 is replaced more frequently than the drum unit 10 for the purpose of maintenance, such as refilling of toner. According to the configuration described above, the developing unit 11 may be attached to and removed from the casing 2 without removing the drum unit 10 from the casing 2. Therefore, frequent maintenance of the developing unit 11 may be carried out easily.

The drum unit 10 may be attached to and removed from the casing 2 less frequently than in a configuration in which the drum unit 10 is attached to and removed from the casing 2 at the time of maintenance of the developing unit 11. Therefore, positioning accuracy of the drum unit 10 with respect to the casing 2 may be kept over a long period of time.

In the printer 1 and the developing unit 11 according to the first embodiment, as illustrated in FIG. 3, the developing unit 11 integrally includes the front wall 65. With this configuration, the front wall 65 allows removal of the drum unit 10 from the casing 2 after removal of the developing unit 11 from the casing 2.

In the printer 1 and the developing unit 11 according to the first embodiment, as illustrated in FIG. 3, the LED unit 12 includes the LED array 41 which emits light to irradiate the photosensitive drum 15, and the positioning rollers 44 which adjust the distance between the LED array 41 and the photosensitive drum 15. Therefore, the positioning rollers 44 allow the LED array 41 to be reliably positioned with respect to the photosensitive drum 15.

In the printer 1 and the developing unit 11 according to the first embodiment, as illustrated in FIG. 3, the developing unit 11 includes the acting portion 66 which causes the LED unit 12 to move from the proximate position to the retracted position when the developing unit 11 is removed from the casing 2, and causes the LED unit 12 to move from the retracted position to the proximate position when the developing unit 11 is attached to the casing 2. Therefore, the LED unit 12 moves between the proximate position and the retracted position in response to the movement of the developing unit 11. This configuration allows the LED unit 12 to move from the proximate position to the retracted position in response to the removal of the developing unit 11 from the casing 2 and, allows the LED unit 12 to move from the retracted position to the proximate position in response to the attachment of the developing unit 11 to the casing 2.

In the printer 1 and the developing unit 11 according to the first embodiment, as illustrated in FIG. 3, the developing unit 11 includes the cam portion 64. Therefore, the cam portion 64 is reliably moved when the developing unit 11 is moved.

In the printer 1 and the developing unit 11 according to the first embodiment, as illustrated in FIGS. 5A, 5B and 6, when the developing unit 11 is attached to the casing 2, the acting portion 66 of the developing unit 11 contacts the corresponding reacting portion 40 of the LED unit 12, whereby the LED unit 12 may move closer to the photosensitive drum 15. Therefore, the LED unit 12 may reliably move from the retracted position to the proximate position in response to the attachment of the developing unit 11 to the casing 2.

In the printer 1 and the developing unit 11 according to the first embodiment, as illustrated in FIGS. 5A, 5B and 6, the LED unit 12 may smoothly move upward in a direction closer to the photosensitive drum 15 by the sliding contact between the rear surface 67 of the acting portion 66 at the front side and the front surface 50 of the reacting portion 40 at the front side and the sliding contact between the upper surface 69 of the acting portion 66 at the rear side and the front surface 50 of the reacting portion 40 at the rear side.

A printer 1 according to a second embodiment of the invention is described with reference to FIGS. 7A and 7B. In the second embodiment, the same parts as those of the first embodiment are denoted by the same reference numerals and description thereof is omitted.

In the first embodiment, the cam portion 64 is integrally formed with the right side of the tray portion 63 of the holding frame 62 of the developing unit 11. In the second embodiment, as illustrated in FIGS. 7A and 7B, a linear cam 81 is provided in the casing 2 but no cam member 64 is provided in a holding frame 62 of a developing unit 60. The linear cam 81 is an example of a moving member which moves the LED unit 12 to a proximate position and to a retracted position with respect to a photosensitive drum 15.

The linear cam 81 is disposed on the lower side of the LED unit 12. The linear cam 81 has a substantially rectangular prism shape extending in the front-rear direction like the cam portion 64 of the holding frame 62 of the first embodiment. Specifically, the linear cam 81 includes two acting portions 82. One of the two acting portions 82 is disposed at a front end portion of the linear cam 81, and the other is disposed at a rear end portion of the linear cam 81. The two acting portions 82 each are an example of a cam.

The acting portion 82 at the front side has, in a side view, a substantially rectangular shape protruding upward from an upper surface of the linear cam 81 and extending in the front-rear direction. Specifically, the acting portion 82 at the front side includes a rear surface 83 and an upper surface 84. The rear surface 83, which is an example of an inclined surface, continues from the upper surface of the linear cam 81 and inclines upward toward the front side. The upper surface 84 continues from a front end portion of the rear surface 83 and extends to the front.

The acting portion 82 at the rear side is a rear end portion of the linear cam 81. An upper surface 85 of the acting portion 82 continues from the upper surface of the linear cam 81 and is cut to incline upward toward the front. The upper surface 85 of the acting portion 82 at the rear side functions as an inclined surface.

The linear cam 81 is held to be slidable in the front-rear direction to an advanced position and a retracted position. At the advanced position, as illustrated in FIG. 7B, a front end portion of the linear cam 81 advances to the front from an opening 4 in the casing 2. At the retracted position, as illustrated in FIG. 7A, a rear end portion of the linear cam 81 is retracted into the opening 4. A front end portion of a compression spring 87 extending in the front-rear direction is in contact with the rear end portion of the linear cam 81. The rear end portion of the compression spring 87 is in contact with a rear wall of the casing 2. Therefore, the linear cam 81 is usually urged to the front toward the advanced position.

The front wall 65 includes, at a right lower end portion thereof, a pressing portion 86 which presses the front end portion of the linear cam 81 to the rear side. The pressing portion 86 has, in a front view, a substantially rectangular prism shape protruding rearward from a rear surface of the front wall 65.

When the developing unit 60 is attached to the casing 2, the pressing portion 86 is in contact with, from the front, the front end portion of the linear cam 81, and the linear cam 81 is positioned at the retracted position against the urging force of the compression spring 87. When the linear cam 81 is disposed at the retracted position, the reacting portion 40 at the front side of the LED unit 12 is in contact with the upper surface 84 of the acting portion 82 at the front side of the linear cam 81, and the reacting portion 40 at the rear side of the LED unit 12 is in contact with the upper surface of the linear cam 81.

Figure 7A:
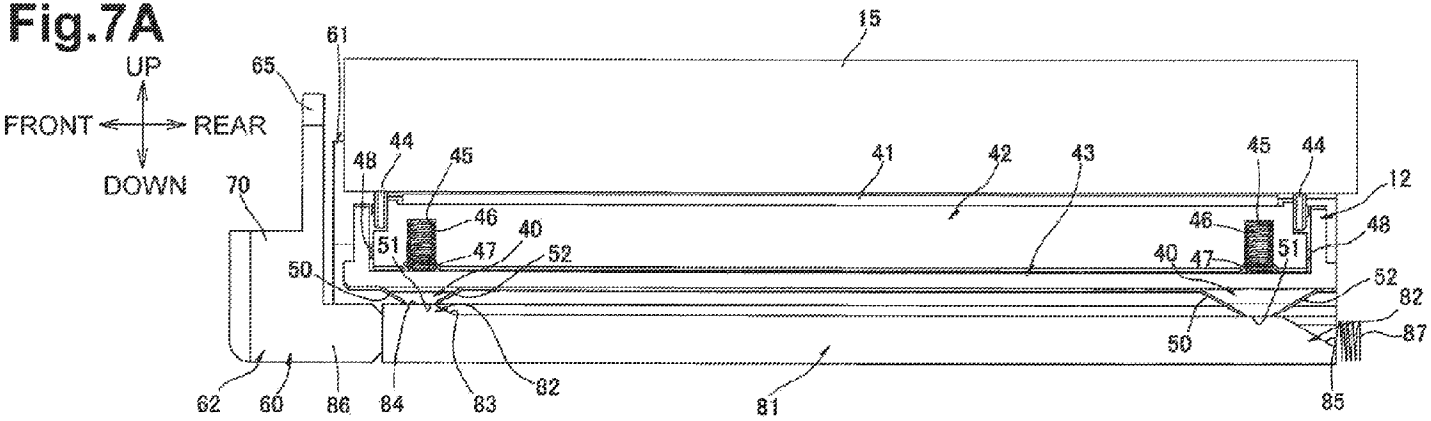
FIG. 7A is right side view of an LED unit of a printer according to a second embodiment of the invention, showing a developing unit is attached to a casing.
Figure 7B:
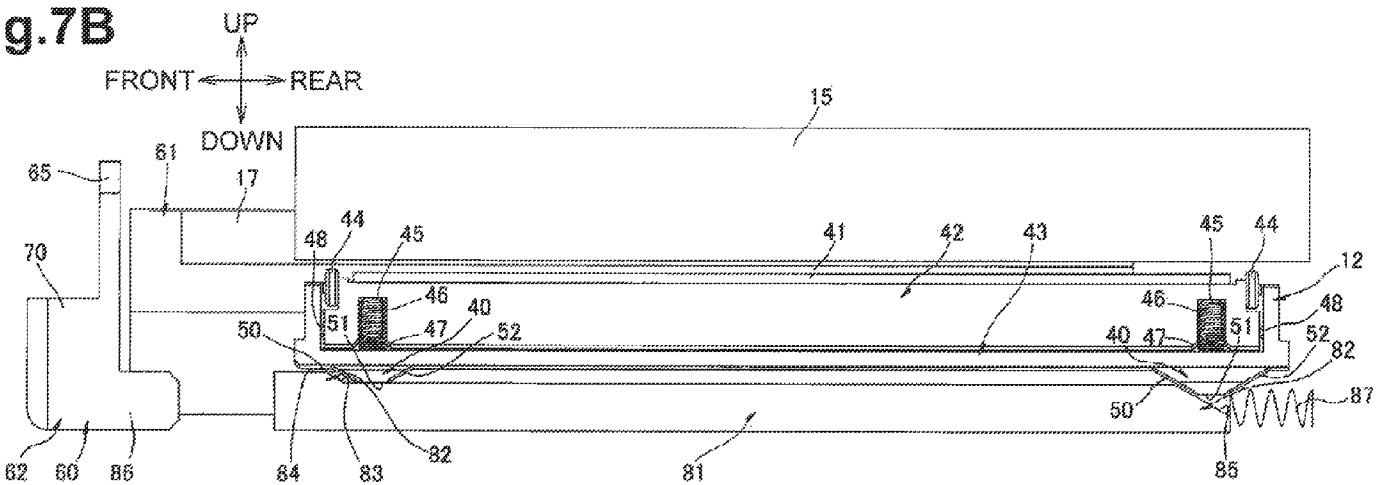
FIG. 7B is a right side view of the LED unit of the printer according to the second embodiment of the invention, showing the developing unit is being removed from the casing.

In the second embodiment, as illustrated in FIG. 7B, in the removal operation of the developing unit 60 from the casing 2, when a user pulls the developing unit 60 to the front, the linear cam 81 slides to the advanced position from the retracted position by an urging force of the compression spring 87. At the same time, the front surface 50 of the reacting portion 40 at the front side of the LED unit 12 faces the rear surface 83 of the acting portion 82 at the front side, and the front surface 50 of the reacting portion 40 at the rear side of the LED unit 12 faces the upper surface 85 of the acting portion 82 at the rear side.

Then, the reacting portion 40 at the front side of the LED unit 12 moves downward along the inclination of the rear surface 83 of the acting portion 82 of the cam portion 64 at the front side. At the same time, the reacting portion 40 at the rear side of the LED unit 12 moves downward along the inclination of the upper surface 85 of the acting portion 82 at the rear side. This allows the LED unit 12 to move downward from a proximate position to a retracted position in a direction away from the photosensitive drum 15.

In an attachment operation of the developing unit 60 to the casing 2, when the developing unit 60 is inserted in the developing unit receiver 37, the pressing portion 86 of the developing unit 60 contacts the front end portion of the linear cam 81 from the front, whereby the linear cam 81 moves from the advanced position to the retracted position against the urging force of the compression spring 87. The upper surface 85 of the acting portion 82 at the rear side faces the front surface 50 of the reacting portion 40 at the rear side of the LED unit 12. At the same time, the rear surface 83 of the acting portion 82 at the front side faces the front surface 50 of the reacting portion 40 at the front side of the LED unit 12.

When the user further pushes the developing unit 60 into the developing unit receiver 37, the rear surface 83 of the acting portion 82 of the linear cam 81 at the front side makes a sliding contact with the front surface 50 of the reacting portion 40 at the front side of the LED unit. At the same time, the upper surface 85 of the acting portion 82 at the rear side of the linear cam 81 makes a sliding contact with the front surface 50 of the reacting portion 40 at the rear side of the LED unit 12. The LED unit 12 is pushed up to move up from the retracted position to the proximate position in a direction closer to the photosensitive drum 15.

When the user further pushes the developing unit 60 into the developing unit receiver 37, the positioning rollers 44 of the LED unit 12 contact a peripheral surface of the photosensitive drum 15 and the LED unit 12 is positioned with respect to the photosensitive drum 15.

In the printer 1 according to the second embodiment, as illustrated in FIGS. 7A and 7B, the linear cam 81 allows the LED unit 12 to move between the proximate position illustrated in FIG. 7A and the retracted position illustrated in FIG. 7B. Therefore, this configuration allows the LED unit 12 to move from the proximate position to the retracted position in response to the removal of the developing unit 60 from the casing 2 and allows the LED unit 12 to move from the retracted position to the proximate position in response to the attachment of the developing unit 60 to the casing 2.

In the second embodiment, the same technical advantages as those of the first embodiment are obtained.

A printer 1 according to a third embodiment of the invention is described with reference to FIGS. 8A and 8B. In the third embodiment, the same parts as those of the second embodiment are denoted by the same reference numerals and description thereof is omitted.

In the second embodiment, in the holding frame 62 of the developing unit 60, the acting portion 82 of the linear cam 81 makes a sliding contact with the corresponding reacting portion 40 of the LED unit 12, whereby the LED unit 12 moves to the proximate position and to the retracted position. In contrast, in the third embodiment, as illustrated in FIGS. 8A and 8B, pivot cams 91 are disposed on the lower side of the LED unit 12. Each pivot cams 91, which is an example of a moving member, contacts the corresponding reacting portion 40 of the LED unit 12. A linear cam 96 causes each pivot cam 91 to pivot so that the LED unit 12 moves between a proximate position illustrated in FIG. 8B and a retracted position illustrated in FIG. 8A.

Figure 8A:
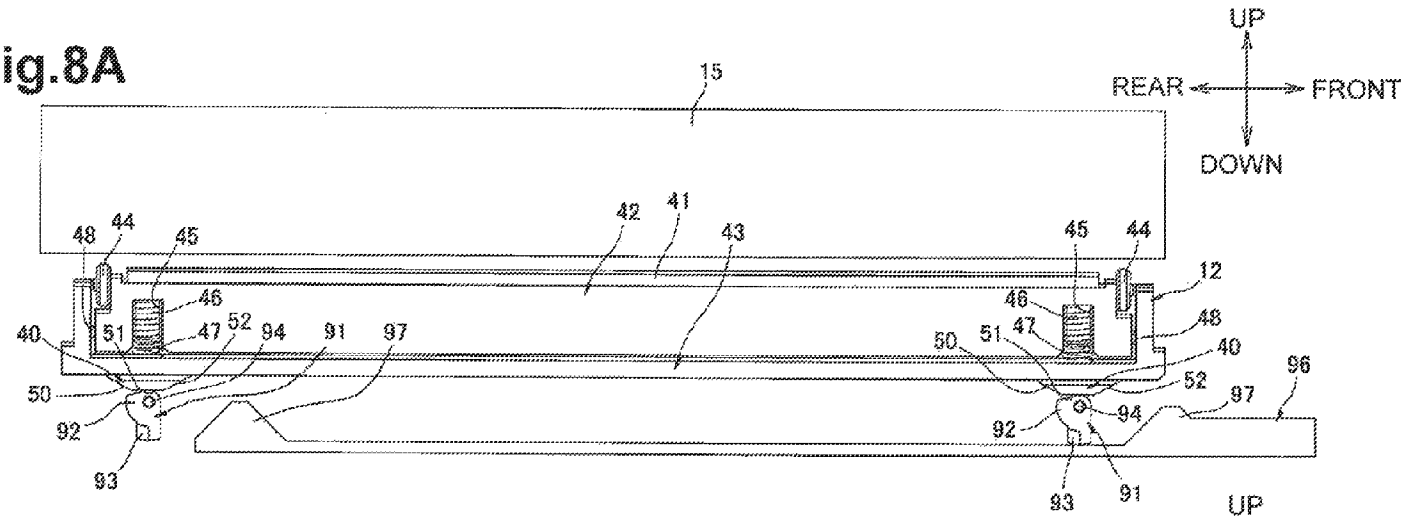
FIG. 8A is right side view of an LED unit of a printer according to a third embodiment of the invention, showing a developing unit is being removed from a casing.

As illustrated in FIG. 8A, each pivot cam 91 includes a cam portion 92 and a contact portion 93. The cam portion 92 has a substantially flat plate shape and extends in the up-down direction when it is not in contact with the linear cam 96. The cam portion 92 is configured to contact the reacting portion 40 of the LED unit 12. The contact portion 93 is configured to contact an acting portion 97 of the linear cam 96. The cam portion 92 has a substantially fan shape extending to the rear from an upper end portion of the pivot cam 91. The contact portion 93 has a substantially rectangular prism shape protruding to the left, i.e., to the near side of FIGS. 8A and 8B, from a lower end portion of the pivot cam 91.

The pivot cam 91 is pivotably held between a first position and a second position about a pivot axis 94 positioned at an upper end portion thereof. The pivot cam 91 is directed downward in the first position as illustrated in FIG. 8A, and pivots rearward from the first position to the second position so as to be directed in the front-rear direction as illustrated in FIG. 8B. The pivot cam 91 is usually urged by a coil spring (not shown) toward the first position. When the pivot cam 91 is in the first position, the distance between the upper end of the pivot cam 91 and the pivot axis 94 is shorter than the distance between the rear end of the pivot cam 91 (i.e., the rear end of the cam portion 92) and the pivot axis 94.

Figure 8B:
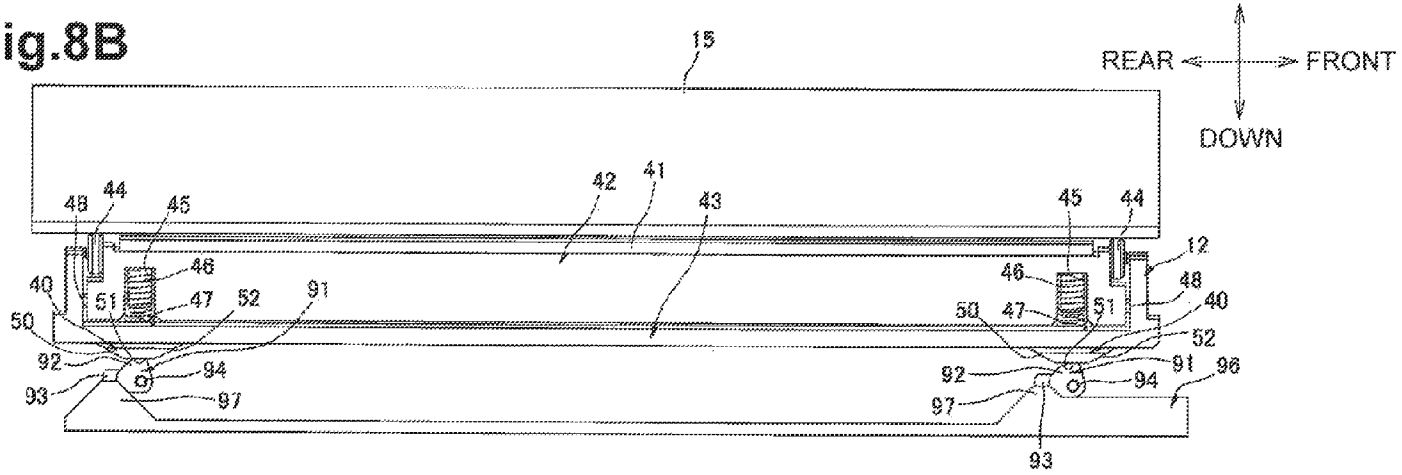
FIG. 8B is a right side view of the LED unit of the printer according to the third embodiment of the invention, showing the developing unit is attached to the casing.

In the third embodiment, when a user pulls the developing unit 60 to the front in the removal operation of the developing unit 60 from the casing 2, the linear cam 96 is slid to an advanced position illustrated in FIG. 8A from a retracted position illustrated in FIG. 8B, and the acting portion 97 of the linear cam 96 moves to the front away from the contact portion 93 of the corresponding pivot cam 91.

At this time, the pivot cam 91 pivots to the first position and the cam portion 92 is directed rearward and moves away from the reacting portion 40 of the LED unit 12. This allows the LED unit 12 to move downward from a proximate position to a retracted position in a direction away from the photosensitive drum 15.

In the attachment operation of the developing unit 60 to the casing 2, when the user inserts the developing unit 60 in the developing unit receiver 37, the linear cam 96 is slid to the retracted position from the advanced position. At this time, each acting portion 97 of the linear cam 96 contact the corresponding contact portion 93 of the pivot cam 91 from the front.

When the user further pushes the developing unit 60 into the developing unit receiver 37, the pivot cam 91 pivots from the first position to the second position, whereby the cam portion 92 of the pivot cam 91 contacts the corresponding reacting portion 40 of the LED unit 12 from below and the reacting portion 40 is pressed upward. At this time, the LED unit 12 moves upward from the retracted position in a direction closer to the photosensitive drum 15.

When the positioning rollers 44 of the LED unit 12 contact the peripheral surface of the photosensitive drum 15, the LED unit 12 is positioned with respect to the photosensitive drum 15.

In the third embodiment, the same technical advantages may be obtained as those of the second embodiment.

A printer 1 according to a fourth embodiment of the invention is described with reference to FIG. 9. In the fourth embodiment, the same parts as those of the first embodiment are denoted by the same reference numerals and description thereof is omitted.

In the first embodiment, the upper right end portion of the front wall 65 of the developing unit 11 is configured to face the front wall of the drum unit 10 so as to prevent removal of the drum unit 10 from the casing 2. In the fourth embodiment, as illustrated in FIG. 9, a front wall 650 of the developing unit 90 is configured not to interfere with the drum unit 10, and a lever 95 is disposed in an LED holding frame 71 of the casing 2 for preventing removal of the drum unit 10 from the casing 2. The lever 95 is an example of a preventing member which faces the front wall of the drum unit 10.

The front wall 650 of the developing unit 90 is cut at its upper right end portion so as not to face the lower left end portion of the front wall of the drum unit 10. The lever 95 extends in the left-right direction and is pivotably held, at the right end portion thereof, on a front surface of the LED holding frame 71 so that a left end portion protrudes into the developing unit receiver 37.

Figure 9A:
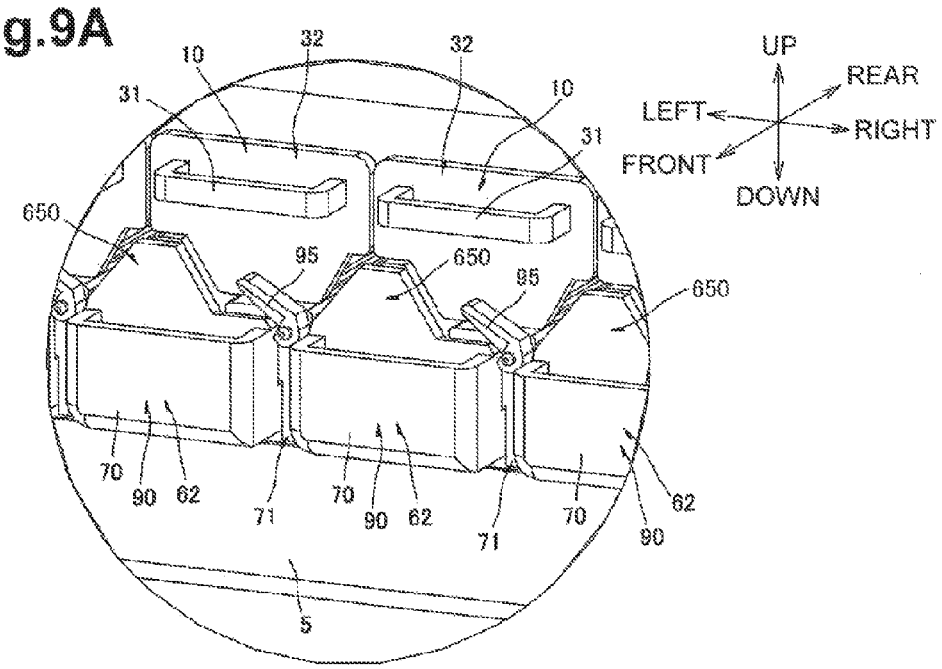
FIG. 9A is a perspective view of a developing unit of a printer according to a fourth embodiment of the invention, showing the developing unit attached to a casing.

Specifically, the lever 95 is configured to pivot between a preventing position and a released position. In the preventing position, the left end portion of the lever 95 has pivoted upward so as to face the front wall of the drum unit 10 as illustrated in FIG. 9A. In the released position, the left end portion of the lever 95 has pivoted downward so as not to face the front wall of the drum unit 10 as illustrated in FIG. 9B.

In the fourth embodiment, as illustrated in FIG. 9A, in a state in which the developing unit 90 is attached to the casing 2, the lever 95 is in the preventing position and is in contact with the upper right end portion of the front wall 650 of the developing unit 90 from above. This configuration prevents removal of the drum unit 10 from the casing 2.

Figure 9B:
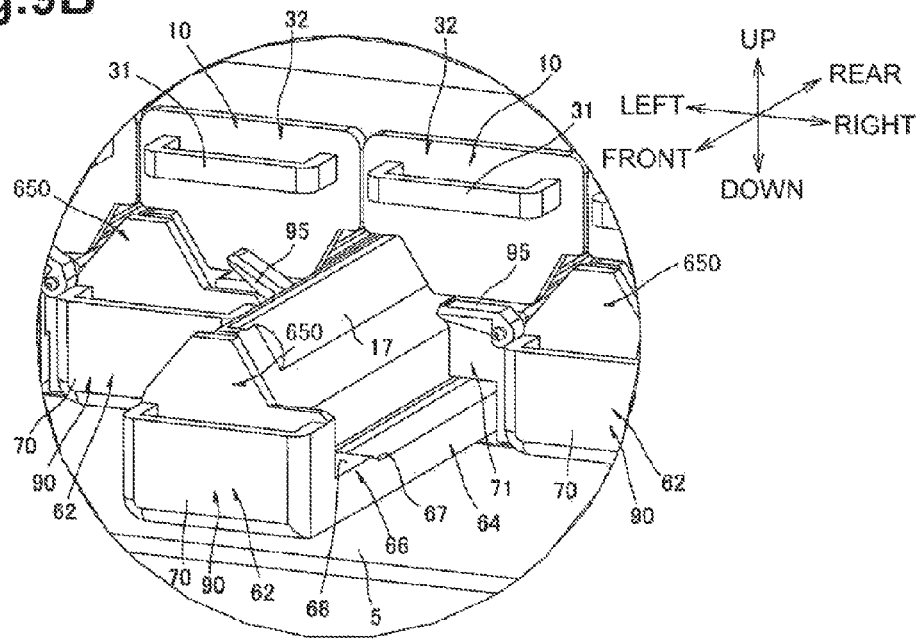
FIG. 9B is a perspective view of the developing unit of the printer according to the fourth embodiment of the invention, showing the developing unit being removed from the casing.

When the user pulls the developing unit 90 to the front, as illustrated in FIG. 9B, the contact relationship between the front wall 650 of the developing unit 90 and the lever 95 is released, and the lever 95 pivots downward. At this time, the lever 95 moves to the released position, the facing relationship between the lever 95 and the drum unit 10 is released. This allows the drum unit 10 to slide to the front.

After removing the developing unit 90 from the casing 2, the user pulls the drum unit 10 to the front to remove the drum unit 10 from the casing 2.

In the fourth embodiment, the same technical advantages as those of the first embodiment are obtained.

In the first embodiment, the cam portion 64 is disposed on the lower side of the LED unit 12. However, the relative positions of the cam portion 64 and the LED unit 12 are not particularly limited as long as the LED unit 12 is configured to be moved closer to or away from the photosensitive drum 15. For example, in another embodiment, the cam portion 64 may be disposed on the left side of the second frame 43 of the LED unit 12, i.e., between the unit main body 61 of the developing unit 60 and the second frame 43 of the LED unit 12.

The reacting portion 40 may be formed to extend to the left from a left surface of the second frame 43.

In the same manner as in the first embodiment, when the developing unit 11 is attached to the casing 2, the acting portion 66 of the cam portion 64 may contact, from below, the reacting portion 40 of the LED unit 12 such that the LED unit 12 moves to the proximate position. When the developing unit 11 is removed from the casing 2, the contact between the acting portion 66 of the cam portion 64 and the reacting portion 40 of the LED unit may be released such that the LED unit 12 moves to the retracted position.

In this embodiment, the same technical advantages as those of the first embodiment are obtained.

While the invention has been described in connection with embodiments of the invention, it will be understood by those skilled in the art that variations and modifications of the embodiments described above may be made without departing from the scope of the invention. Other embodiments will be apparent to those skilled in the art from a consideration of the specification or practice of the invention disclosed herein. It is intended that the specification and the described examples are considered merely as exemplary of the invention, with the true scope of the invention being defined by the following claims.

What is claimed is:

1. An image forming apparatus comprising:

a casing;

a drum unit comprising a photosensitive drum configured to rotate about an axis extending in an axial direction and carry a developer image;

a developing unit comprising a developing roller configured to supply developer to the photosensitive drum;

an irradiating unit comprising a light emitting member and a cam follower, the light emitting member being configured to irradiate the photosensitive drum, and the irradiating unit being configured to move between a retracted position and a proximate position which is closer to the photosensitive drum than the retracted position;

a moving member extending in the axial direction and configured to move in the axial direction between a first position and a second position, the moving member comprising a cam;

and an endless belt facing the photosensitive drum of the drum unit, wherein the drum unit is disposed below the endless belt and the irradiating unit is disposed below the photosensitive drum, wherein the cam follower of the irradiating unit is configured to follow the cam, in response to movement of the moving member from the second position to the first position, so as to move the irradiating unit from the retracted position to the proximate position, and is configured to follow the cam, in response to movement of the moving member from the first position to the second position, so as to move the irradiating unit from the proximate position to the retracted position.

2. The image forming apparatus according to claim 1, wherein the cam of the moving member is configured, in response to the movement of the moving member from the second position to the first position, to push the cam follower of the irradiating unit in such a direction that the irradiating unit moves toward the photosensitive drum.

3. The image forming apparatus according to claim 1, wherein the developing unit is configured to be removed from the casing in the axial direction, in response to the movement of the moving member from the first position to the second position.

4. The image forming apparatus according to claim 1, wherein the developing unit is configured to move in the axial direction together with the moving member.

5. The image forming apparatus according to claim 1, wherein the moving member is disposed below the irradiating unit.

6. The image forming apparatus according to claim 1, wherein the cam of the moving member has an inclined surface which is inclined with respect to the axial direction such that an upstream end of the inclined surface in a moving direction of the moving member from the second position to the first position is closer to the photosensitive drum than a downstream end of the inclined surface in the moving direction.

7. The image forming apparatus according to claim 1, wherein the cam follower of the irradiating unit has an inclined surface which is inclined with respect to the axial direction such that an upstream end of the inclined surface in a moving direction of the moving member from the second position to the first position is closer to the photosensitive drum than a downstream end of the inclined surface in the moving direction.

8. The image forming apparatus according to claim 1, wherein the cam is configured to move in the axial direction in response to movement of the moving member in the axial direction.

9. The image forming apparatus according to claim 1, wherein the moving member further comprises a tray portion which supports the developing unit.

10. The image forming apparatus according to claim 1, wherein the irradiating unit further comprises an urging member configured to urge the cam follower toward the cam when the moving member is in the first position, the cam follower being positioned between the urging member and the cam of the moving member in the first position.

* * * * *